US005921121A

United States Patent [19]

Tang

[11] Patent Number: 5,921,121

[45] Date of Patent: Jul. 13, 1999

[54] ADJUSTABLE KEY-TYPE SPRING PIN LOCK CYLINDER

[76] Inventor: Xu Fai Tang, 5310 220th St. SW, Mountlake Terrace, Wash. 98043

[21] Appl. No.: 08/844,575

[22] Filed: Apr. 18, 1997

[51] Int. Cl.[6] ..... E05B 35/08

[52] U.S. Cl. ..... 70/337; 70/382

[58] Field of Search ..... 70/337, 338, 340–343, 70/382–386

[56] References Cited

U.S. PATENT DOCUMENTS

| | | | |
|---|---|---|---|
| 1,561,223 | 11/1925 | Fremon | 70/382 |
| 1,565,556 | 12/1925 | Fremon | 70/382 |
| 1,565,557 | 12/1925 | Fremon | 70/382 |
| 2,113,007 | 4/1938 | Swanson | 70/385 |
| 2,603,081 | 7/1952 | Pelle | 70/382 X |
| 3,143,875 | 8/1964 | Wellekens | 70/382 |
| 3,261,188 | 7/1966 | Kerr | 70/382 X |
| 3,462,983 | 8/1969 | Evanish | 70/337 X |
| 3,599,456 | 8/1971 | Bessim | 70/383 X |
| 3,728,880 | 4/1973 | Falk | 70/382 X |
| 3,943,309 | 3/1976 | Kawamoto et al. | 70/337 X |
| 4,094,175 | 6/1978 | Pechner | 70/383 X |
| 4,233,828 | 11/1980 | Davenbaugh | 70/383 X |
| 4,424,693 | 1/1984 | Best et al. | 70/369 |
| 4,440,009 | 4/1984 | Smith | 70/385 |
| 4,729,231 | 3/1988 | Wu | 70/383 |
| 4,836,002 | 6/1989 | Monahan | 70/382 |
| 4,850,210 | 7/1989 | Adler et al. | 70/383 |
| 4,912,953 | 4/1990 | Wobig | 70/383 |
| 5,088,306 | 2/1992 | Field | 70/375 |
| 5,226,304 | 7/1993 | Scott | 70/386 X |
| 5,325,690 | 7/1994 | Adler et al. | 70/383 |

FOREIGN PATENT DOCUMENTS

| | | | |
|---|---|---|---|
| 2202573 | 9/1988 | United Kingdom | 70/382 |

*Primary Examiner*—Suzanne Dino Barrett
*Attorney, Agent, or Firm*—Christensen O'Connor Johnson & Kindness, PLLC

[57] ABSTRACT

The present apparatus provides an adjustable key-type spring pin lock cylinder. The spring pin lock cylinder includes a lock core (1), a first core sleeve (2), and a second core sleeve (3). At the rear section of the lock core, two depressions, each with a countersink on one side, are made. Two steel balls (4) are respectively placed into the depressions. On the rear cover (5) of the lock, there are two through-holes in which the press rods (6) and the springs (7) are placed. By turning the adjusting lever (10) on the supporting stand (9), either key may be selected to open the lock or only one of the two keys can open the lock.

5 Claims, 5 Drawing Sheets

ADJUSTABLE KEY-TYPE SPRING PIN LOCK CYLINDER

FIELD OF THE INVENTION

The present invention relates to a door lock cylinder and, more particularly, to a door lock cylinder with which two different keys may be selectively used to gain or prevent entry.

BACKGROUND OF THE INVENTION

People usually have only one key to open a door lock. After the key is lost or, for any reason, loaned or given to another person, such as a nurse, a relative, a tenant, or a maintenance worker, the house owner may worry about the integrity of the door lock. Currently, one's only remedy is to have the door lock replaced or rekeyed in order to have a new key. Nowadays, in hotels, apartments, and office buildings, locks with multiple keys are also used. However, the owner cannot selectively allow only one key to open the lock and not the other keys.

SUMMARY OF THE INVENTION

This invention has improved the mechanism of the lock. The present invention provides a new kind of lock that has two different keys. By rotating the adjustable key-type lever, one of the two keys can open the lock, while the other key cannot. In this case, whether the key has been lost or given to another person, the house owner can easily select the other key afterward and the integrity of the door lock can be ensured.

The lock of the present invention includes a lock core, first core sleeve, second core sleeve, pressure spring, press rod, transmission lever, key, and rear cover. On the circumference between the two rear-end sections of lock core and first core sleeve, there is a depression that is composed of two semicircular depressions, one on the lock core and the other on the first core sleeve. Near the outlet on the inner wall of the semicircular depression of the lock core, there is an offcenter countersink. At one point on the second core sleeve, there is another depression that is composed of two semicircular depressions, one on the first core sleeve and the other on the second core sleeve. Near the outlet on the inner wall of the semicircular depression at one side of the first core sleeve, there is an offcenter countersink. The two depressions have the same depth and diameter. Each depression is adapted to receive a steel ball. Outside each steel ball, a supplementary key-type adjustment device is installed.

The advantage of this new invention is that each lock has two keys. By adjusting the key-type adjusting lever, either both keys can open the lock, or one of the keys can open the lock, while the other key cannot, thus ensuring the security of the door lock. It can be used in various models of door lock bodies.

BRIEF DESCRIPTION OF THE DRAWINGS

With reference to the attached FIGURES, an illustrated description of the invention is given.

DETAILED DESCRIPTION OF THE PREFERRED EMBODIMENT

Figure 1:
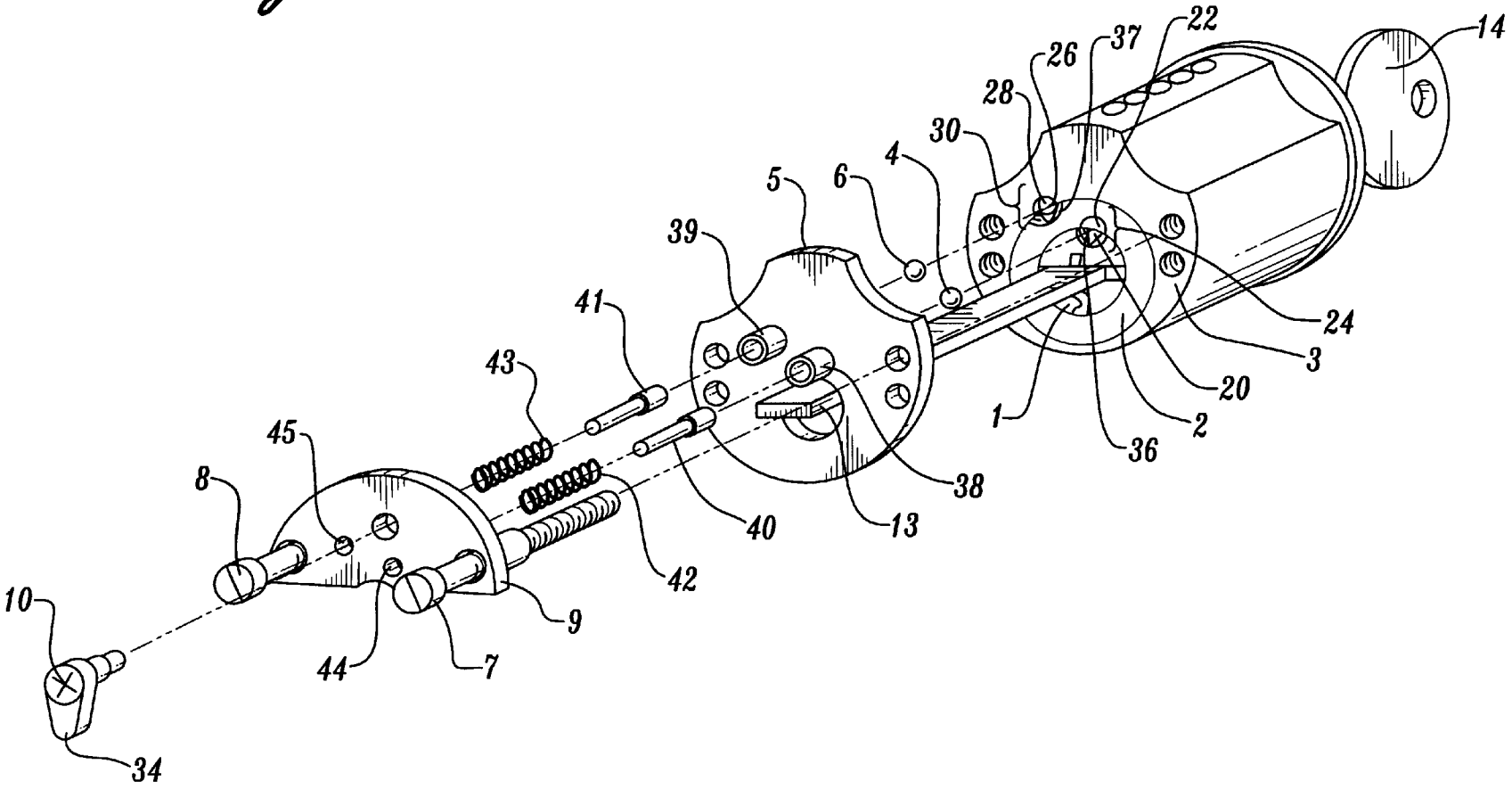
FIG. 1 is a schematic drawing of the component structure in a second state of operation according to the lock of the present invention.
Figure 2:
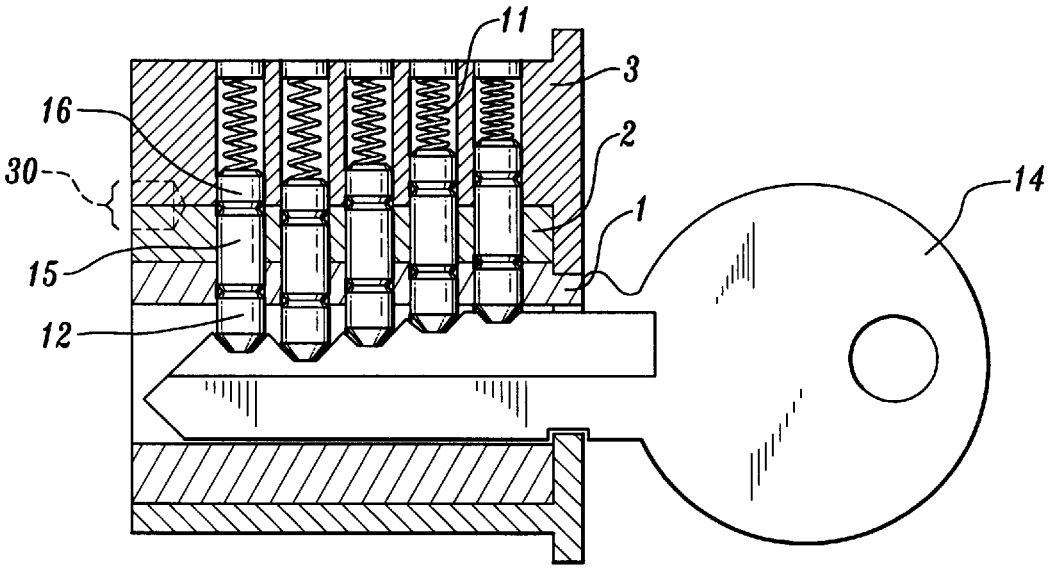
FIG. 2 is a sectional drawing of the combined lock of FIG. 1.
Figure 3:
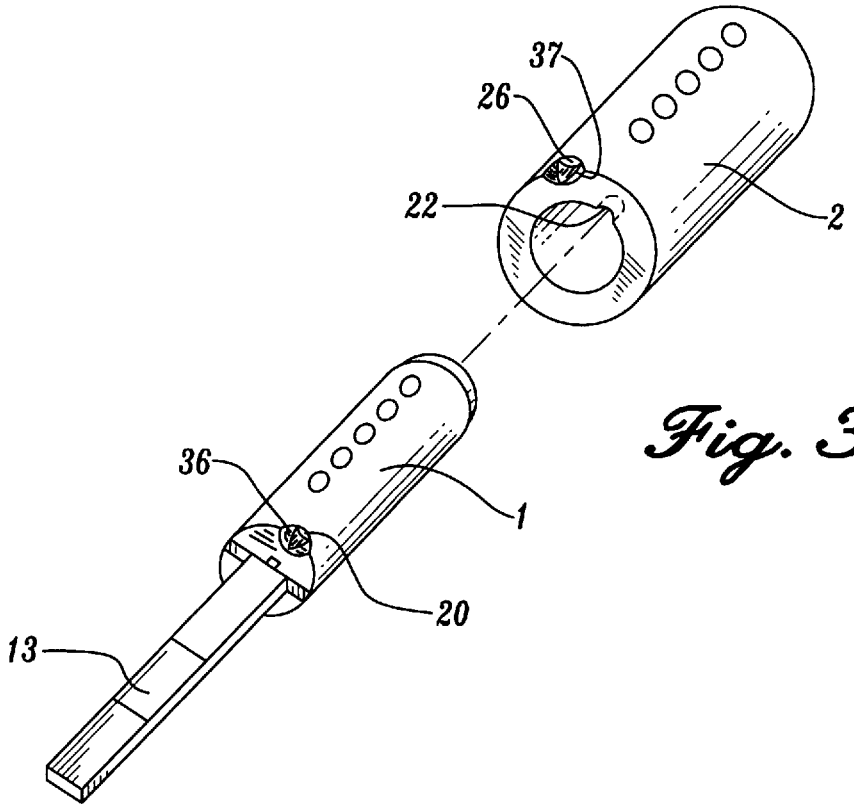
FIG. 3 is a perspective view of a portion of the lock of FIG. 1.
Figure 4:
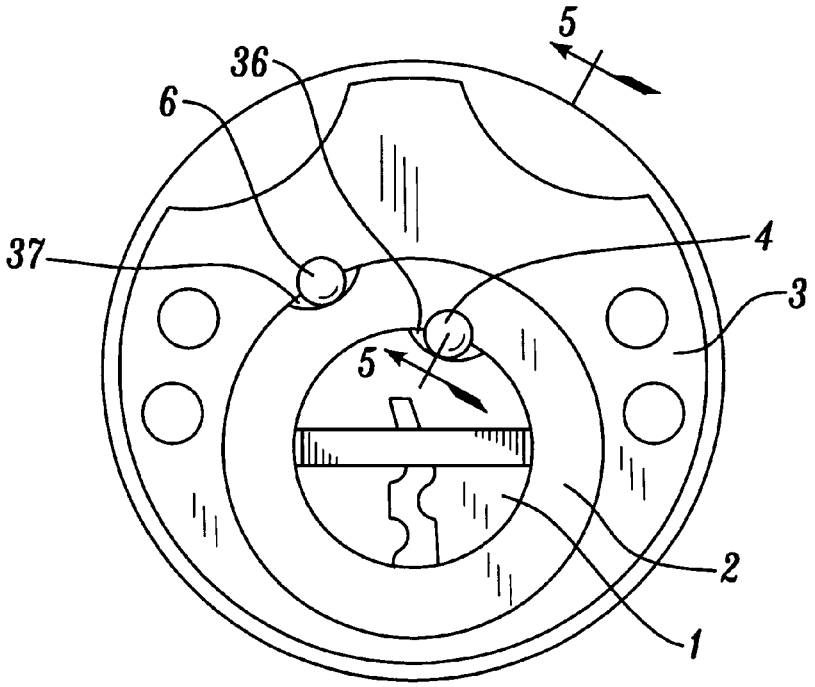
FIG. 4 is an end view of the lock of FIG. 1 at a first stage of rotation.
Figure 5:
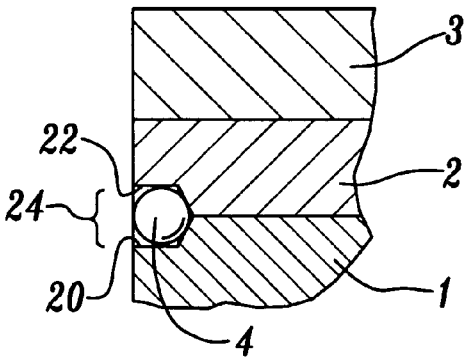
FIG. 5 is a side view of the stage of operation of FIG. 4.
Figure 6:
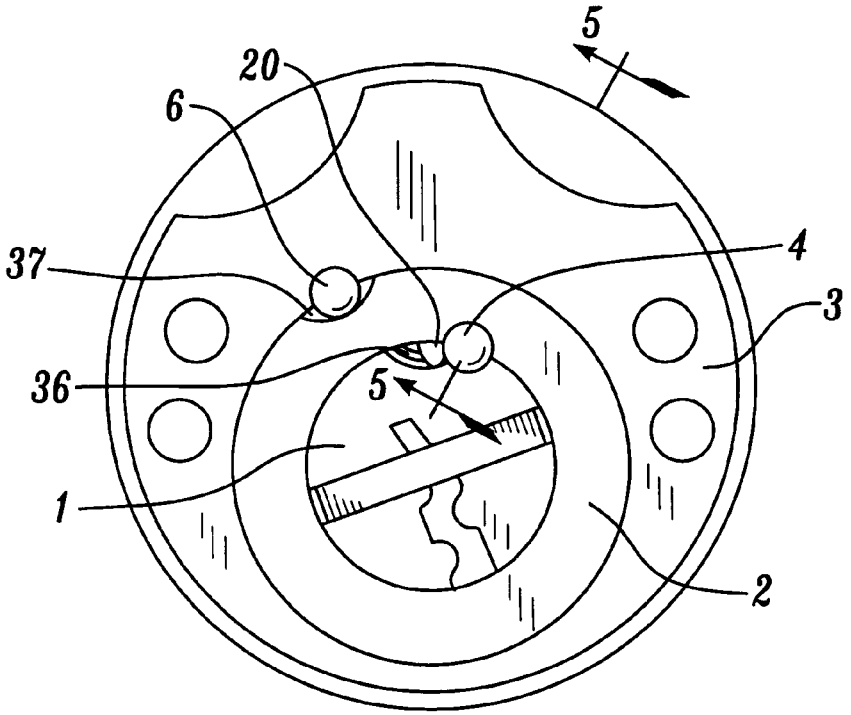
FIG. 6 is an end view of the lock of FIG. 1 at a further stage of rotation.
Figure 7:
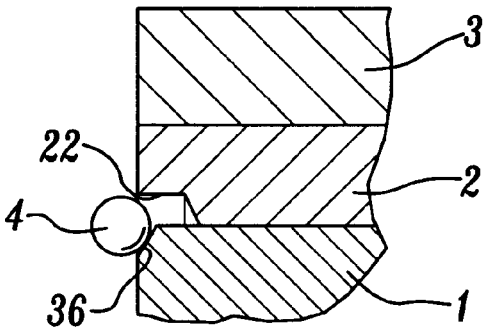
FIG. 7 is a side view of FIG. 6.
Figure 8:
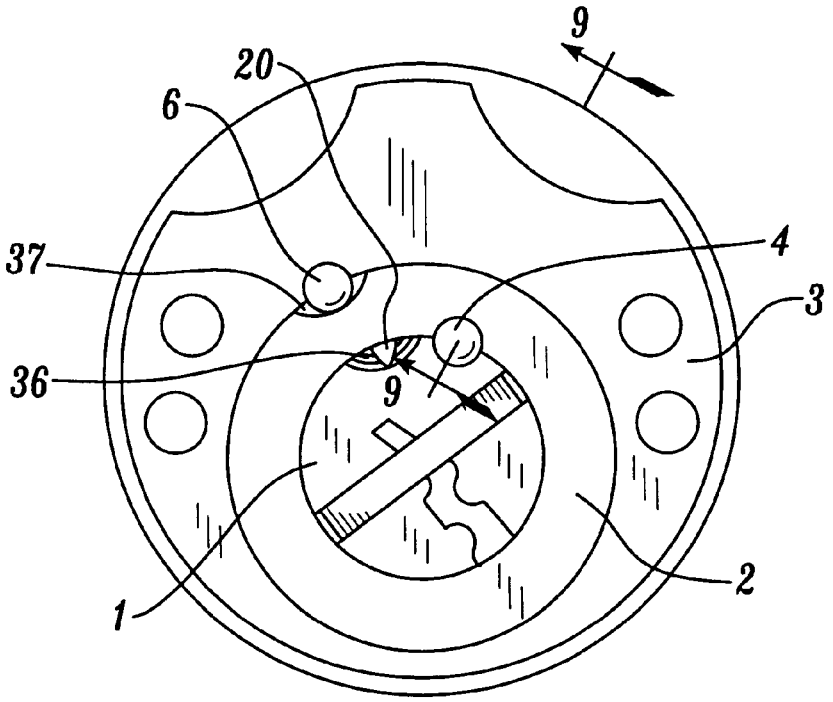
FIG. 8 is an end view of the lock of FIG. 1 at an even further stage of rotation.
Figure 9:
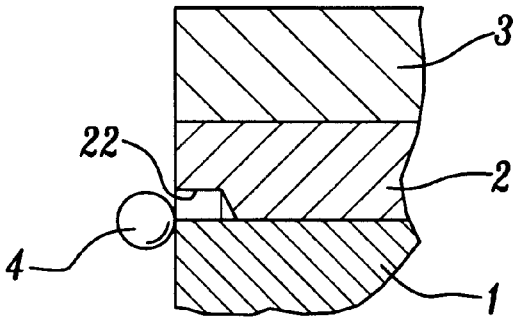
FIG. 9 is a side view of FIG. 8.

According to FIGS. 1, 2, and 3, the present invention includes a lock core 1, which is nested in a first core sleeve 2, which, in turn, is nested in a second core sleeve 3, a spring 11, a first layer spring rod 12, a second layer spring rod 15, a third layer spring rod 16, a transmission lever 13, a key 14, and a rear cover 5. On the circumference between the two rear-end sections of the lock core 1 and first core sleeve 2, there is a first receptacle 24 that is composed of a first semicircular depression 20 and a second semicircular depression 22, the first on the lock core 1 and the second on the first core sleeve 2. Near the outlet on the inner wall of the first semicircular depression of the lock core 1, there is a first offcenter countersink 36. At a point on the circumference between the two rear-end sections of the first core sleeve 2 and the second core sleeve 3, there is a second receptacle 30 that is composed of a third semicircular depression 26 and a fourth semicircular depression 28, the third semicircular depression on the first core sleeve 2 and the fourth semicircular depression on the second core sleeve 3. Near the outlet on the inner wall of the third semicircular depression at one side of the first core sleeve 2, there is an offcenter countersink 37. The two semicircular depressions have the same depth and diameter. The first and second receptacles are adapted to receive first and second steel balls 4 and 6. Outside the steel balls, a supplementary key-type adjustment structure is installed. The supplementary key-type adjustment structure includes the rear cover 5 of the lock and the supporting stand 9 of the key-type adjusting lever 10. On the surface of the rear cover 5, there are two through-holes located at positions that coincide with the two receptacles. The position of the first through-hole 38 coincides with the first receptacle 24 and the position of the second through-hole 39 coincides with the second receptacle 30. The diameters of the through-holes are the same. A first rod 40 is inserted in through-hole 38. A first pressure spring 42 is placed at the end of the first rod. A second rod 41 is inserted in through-hole 39. A second pressure spring 43 is placed at the end of the second rod. At the back side of the rear cover 5, the supporting stand 9 of the key-type adjusting lever 10 is installed and linked by two screw bolts 8. In the supporting stand 9 a third through-hole 44 is positioned to coincide with the first through-hole 38 in the rear cover 5, and a fourth through-hole 45 is positioned to coincide with the second through-hole 39 in the rear cover 5. First rod 40 is inserted into the third through-hole 44 in the supporting stand 9. The second rod 41 is inserted into the fourth through-hole 32 in the supporting stand 9. In the supporting stand 9, the key-type adjusting lever 10 is installed. When rotating movement is performed by the key-type adjusting lever 10, the swivel rod head 34 follows the movement of the rail and covers either the third through-hole 44 (as depicted in FIG. 1), the fourth through-hole 45, or neither of the through-holes.

When the key-type adjusting lever 10 is turned to three predetermined angle positions, the lock will have three usage states. The lock of the present invention has A-type and B-type keys. The A-type key can open the lock core 1 and the B-type key can open the first core sleeve 2:

First state: A-type key can open the lock, B-type key cannot.

Second state: B-type key can open the lock, A-type key cannot.

Third state: Either A-type key or B-type key can open the lock.

Referring to FIGS. 4–9, when the first state is desired, the key-type adjusting lever 10 is initiated to a first predetermined angle position. The swivel rod head 34 will then completely cover the fourth through-hole 32 in supporting stand 9. The position of the fourth through-hole 45 is coincident with the second receptacle 30 formed by the third and fourth semicircular depressions at the back side of the first core sleeve 2 and the second core sleeve 3. When the A-type key is inserted into the lock core 1, all upper ends of the first layer spring rods 12 are leveled with the outer circle of the lock core 1, as depicted in FIG. 2, thus allowing the lock core 1 to rotate within the first core sleeve 2. When the A-type key is rotated, the first steel ball 4 in the first receptacle 24 at the rear ends of the lock core 1 and the first core sleeve 2 will be moved outward, due to the double extrusion by the radial force and axial force created by the first offcenter countersink 36, which is specially designed in one side of the lock core 1. The first steel ball 4 will then roll into the corresponding first through-hole 38 of the rear cover 5 so as to push the first rod 40 to overcome the pressure of the first pressure spring 42 and effect axial movement. The rear end of the first rod 40 will extend through the corresponding third through-hole 44 of the supporting stand 9. Therefore, the A-type key can be rotated until the lock is opened. When the B-type key is inserted into the lock core 1, all the upper ends of the second layer spring rods 15 will be leveled with the outer circle of the first core sleeve 2. Referring to FIG. 2, the lengths of the second layer spring rods 15 are such that when the upper ends are leveled with the outer circle of the first core sleeve 2, the lock core 1 and the first core sleeve 2 will be locked together such that the lock core 1 will no longer be able to rotate freely within the first core sleeve 2. In this case, the first core sleeve 2 could drive the lock core 1 to rotate, following the rotation of the B-type key. But at this moment, the swivel rod head 34 of the key-type adjusting lever 10 will completely cover the fourth through-hole 32 on the supporting stand 9, which corresponds to the second receptacle 30 formed by the third and fourth semicircular depressions at the back sides of the first core sleeve 2 and the second core sleeve 3, respectively. This causes the corresponding second rod 41 and the second steel ball 6 to also be covered so that they cannot effect axial movement. Therefore, the first core sleeve 2 and the second core sleeve 3 are locked together by the second steel ball 6. As a result, the B-type key cannot be rotated to open the lock.

When the second state is desired, the key-type adjusting lever 10 is rotated to a second predetermined angle position. The swivel rod head 34 will then completely cover the third through-hole 44 in the supporting stand 9. The position of this through-hole is coincident with the first receptacle 24 formed by the first and second semicircular depressions at the back side of the lock core 1 and the first core sleeve 2, respectively. When the B-type key is inserted into the lock core 1, all the upper ends of the second layer spring rods 12 are leveled with the outer circle of the first core sleeve 2 thereby locking the lock core 1 and the first core sleeve 2 together. When the B-type key is rotated, the second steel ball 6 in the depression at the rear ends of the first core sleeve 2 and the second core sleeve 3 will be moved outward, due to the double extrusion by the radial force and axial force created by the second offcenter countersink 26, which is made in one side of the first core sleeve 2. The second steel ball 6 will then roll into the corresponding second through-hole 39 of the rear cover 5 so as to push the second rod 41 to overcome the pressure of the second pressure spring 43 and effect axial movement. The rear end of the second rod 41 will extend through the corresponding fourth through-hole 45 of the supporting stand 9. Therefore, the B-type key can be rotated until the lock is opened. When the A-type key is inserted into the lock core 1, all the upper ends of the first layer spring rods 12 will be leveled with the outer circle of the lock core 1. In this case, the lock core 1 could otherwise be rotated within the first core sleeve 2, but for the swivel rod head 34 of the adjusting lever 10 now completely covering the third through-hole on the supporting stand 9, which corresponds to the first receptacle 24 formed by the first and second semicircular depressions at the back sides of the lock core 1 and the first core sleeve 2, respectively. This causes the corresponding first rod 40 and the first steel ball 4 to be covered so that they cannot effect axial movement. Therefore, the lock core 1 and the first core sleeve 2 are locked together by the first steel ball 4. Thus the A-type key cannot be rotated to open the lock.

When the third state is desired, the key-type adjusting lever 10 is rotated to a third predetermined angle position. Now the swivel rod head will be completely spaced apart from the third and fourth through-holes in the supporting stand 9. When the A-type key is inserted into the lock core 1, all the upper ends of the second layer spring rods 12 are leveled with the outer circle of the lock core 1. When the A-type key is rotated, the first steel ball 4 in the first receptacle 24 at the rear ends of the lock core 1 and the first core sleeve 2 will be moved outward, due to the double extrusion by the radial force and the axial force created by the first offcenter countersink 36 that is made in one side of the lock core 1. The first steel ball 4 will then roll into the corresponding first through-hole 38 of the rear cover 5 so as to push the first rod 40 to overcome the pressure of the first pressure spring 42 and effect axial movement. The rear end of the first rod 40 will extend through the corresponding third through-hole of the supporting stand 9. Therefore, the A-type key can be rotated until the lock is opened. When the B-type key is inserted into the lock core 1, all the upper ends of the second layer spring rods 12 are leveled with the outer circle of the first core sleeve 2 thereby locking the lock core 1 and the first core sleeve 2 together. When the B-type key is rotated, the second steel ball 6 in the second receptacle 30 at the rear ends of the first core sleeve 2 and the second core sleeve 3 will be moved outward, due to the double extrusion by the radial force and axial force created by the second offcenter countersink 37 that is made in one side of the first core sleeve 2. Then the second steel ball 6 will roll into the corresponding second through-hole 39 of the rear cover 5 so as to push the second rod 41 to overcome the pressure of the second pressure spring 43 and effect axial movement. The rear end of the second rod 41 will extend through the corresponding fourth through-hole 45 of the supporting stand 9. Therefore the B-type key can be rotated until the lock is opened.

In accordance with the same working principle, whenever the combined lock is added in one lock core sleeve and one layer of spring rods and one set of components with the characteristics of this invention, one more type of key can be made for this key-type alternative mechanism lock.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. An adjustable key-type lock cylinder for a lock, the cylinder comprising:

a lock core arranged to receive a first key and a second key, the lock core being arranged to rotate to open the lock with the first key;

a first core sleeve that receives the lock core, the first core sleeve being arranged to rotate to open the lock with the second key;

a second core sleeve that receives the first core sleeve;

means for selectively coupling the lock core to the first core sleeve;

means for selectively coupling the first core sleeve to the second core sleeve;

a plate coupled to a first end of the second core sleeve, the plate including first and second holes; and means for selectively enabling the means for selectively coupling the lock core to the first core sleeve and the means for selectively coupling the first core sleeve to the second core sleeve, the enabling means having first, second, and third states, the enabling means including a lever rotatably coupled to the plate and rotatable between first, second, and third positions corresponding to the first, second, and third states, respectively, the lever covering the second hole in the first position, the lever covering the first hole in the second position, and the lever being spaced apart from the first and second holes in the third position wherein:

in the first state the enabling means disables the means for selectively coupling the lock core to the first core sleeve such that rotation of the first key opens the lock and enables the means for selectively coupling the first core sleeve to the second core sleeve such that opening the lock with the second key is prevented;

in the second state the enabling means enables the means for selectively coupling the lock core to the first core sleeve such that rotation of the first key to open the lock is prevented and the enabling means disables the means for selectively coupling the first core sleeve to the second core sleeve such that rotation of the second key rotates the first core sleeve to open the lock; and in the third state the enabling means disables the means for selectively coupling the lock core to the first core sleeve such that rotation of the first key opens the lock and the enabling means disables the means for selectively coupling the first core sleeve to the second core sleeve such that rotation of the second key rotates the first core sleeve to open the lock.

2. The cylinder of claim 1, wherein the means for selectively coupling the lock core to the first core sleeve comprises:

a first member received in the second hole;

means for biasing the first member toward the lock core and first core sleeve; and means for urging the first member away from the lock core and the first core sleeve when the lock core is rotated.

3. The cylinder of claim 2, wherein the urging means comprises:

a first semicircular depression included in a first end of the lock core;

a second semicircular depression included in a first end of the first core sleeve; and a first ball received in the first and second semicircular depressions when the first and second semicircular depressions are aligned toward each other, the first ball being urged out of the first and second semicircular depressions and into the second hole to urge the first member against the biasing means when the lock core is rotated.

4. The cylinder of claim 1, wherein the means for selectively coupling the first core sleeve to the second core sleeve comprises:

a second member received in the first hole;

means for biasing the second member toward the first core sleeve and second core sleeve; and means for urging the second member away from the first core sleeve and second core sleeve when the first core sleeve is rotated.

5. The cylinder of claim 4, wherein the urging means comprises:

a third semicircular depression in a first end of the first core sleeve;

a fourth semicircular depression in a first end of the second core sleeve; and a second ball received in the third and fourth semicircular depressions when the third and fourth semicircular depressions are aligned toward each other, the second ball being urged out of the third and fourth semicircular depressions and into the first hole to push the second member against the biasing means when the first core sleeve is rotated.

* * * * *